US006922862B1

(12) United States Patent
Thompson

(10) Patent No.: US 6,922,862 B1
(45) Date of Patent: Aug. 2, 2005

(54) MATTRESS TOPPER

(76) Inventor: Jim M. Thompson, 3908 Shortgrass Rd., Edmond, OK (US) 73003

( * ) Notice: Subject to any disclaimer, the term of this patent is extended or adjusted under 35 U.S.C. 154(b) by 399 days.

(21) Appl. No.: 10/307,772

(22) Filed: Dec. 2, 2002

(51) Int. Cl.[7] ..... A47C 27/16; A47C 27/14; A47G 9/00

(52) U.S. Cl. ..... 5/691; 5/500

(58) Field of Search ..... 5/691, 740, 420, 5/699, 502, 500, 484, 496, 498

(56) References Cited

U.S. PATENT DOCUMENTS

| | | | | |
|---|---|---|---|---|
| 1,841,410 | A | 1/1932 | Karr | |
| 2,099,427 | A | 11/1937 | Karr | |
| 2,222,782 | A | * 11/1940 | Moses | 5/500 |
| 2,516,363 | A | * 7/1950 | Block et al. | 5/500 |
| 2,660,735 | A | * 12/1953 | Baum | 5/484 |
| 4,454,615 | A | 6/1984 | Whitney | |
| 4,549,323 | A | * 10/1985 | Brockhaus | 5/668 |
| 4,955,095 | A | 9/1990 | Gerrick | |
| 5,007,123 | A | 4/1991 | Salyards | |
| 5,117,519 | A | 6/1992 | Thomas | |
| 5,910,081 | A | 6/1999 | Graham | |
| 5,950,264 | A | 9/1999 | Wyner et al. | |
| 5,987,668 | A | 11/1999 | Ackley | |
| 6,009,579 | A | 1/2000 | Pedersen | |
| 6,016,582 | A | 1/2000 | Larson | |
| 6,163,907 | A | 12/2000 | Larson | |
| 6,272,707 | B1 | 8/2001 | Robrecht et al. | |

* cited by examiner

*Primary Examiner*—Alexander Grosz
(74) *Attorney, Agent, or Firm*—Fellers, Snider, Blankenship, Bailey & Tippens, P.C.; Terry L. Watt

(57) ABSTRACT

In accordance with the instant invention, there is provided a mattress topper which is designed to be placed atop a mattress and/or box spring combination. In the preferred arrangement, the topper consists of a sandwich of three layers. The outer layers are preferably comprised of open cell foam of a thickness about equal to one inch or so. The inner layer is an impermeable central liner which is preferably made of a material such as plastic. The function of the central liner is to prevent the migration of fluids from one side of the topper to the other. Thus, although the foam upper layer is very absorbent, an inadvertent spill or other deposit of moisture will be blocked in its migration through the topper by the central waterproof member, thereby protecting both the lower member and the mattress below from exposure to the moisture. In a preferred embodiment, the inner layer is comprised of a foam stiffener core encased by an impermeable wrapping.

15 Claims, 1 Drawing Sheet

MATTRESS TOPPER

This invention relates generally to commercial and residential bedding and, more particularly, to mattress pads or toppers.

BACKGROUND OF THE INVENTION

Generally speaking, a mattress topper is a removable separate solid pad or inflatable mat that is designed to rest atop a conventional mattress and/or mattress-box spring combination and is sized to be commensurate therewith. One purpose of a topper is to cushion the feel of a mattress that is too firm and hide imperfections in an otherwise useful mattress. In one typical arrangement, the topper is a pad constructed of open-cell foam rubber and may be optionally encased in a cotton, wool, or a PVC plastic (or other waterproof) covering. In other arrangements, the topper might be inflatable and might or might not contain a foam core.

Whatever its construction, the mattress topper has a wide variety of applications. In a medical setting, specialized foam pads are placed between the patient and the hospital bed to increase the comfort of the bedfast patient and reduce the risk that pressure sores will develop. In a residential setting, a topper is similarly used to increase the comfort of the sleeper and might be used to hide imperfections in the underlying mattress or provide increased warmth to the sleeper. All of this is well known to those of ordinary skill in the art.

However, it is the commercial mattress rental/resale industry that is the focus of the instant disclosure. Until relatively recently, state law in a number of states forbade the sale or lease of used bedding, as it was felt to pose a significant health risk to the consuming public. However, with the advent of modern methods of cleaning and disinfecting the Departments of Health in the various states have allowed such commercial activity, provided that the consumer is notified and the bedding is cleaned per regulation. In that context, it should be noted that one important function of a mattress topper is to act as a protective barrier and to reduce the amount of soiling that a mattress would otherwise experience. Obviously, if a topper is ruined by fouling or contamination, that may be a lesser financial impact than if the mattress had been similarly ruined, since the topper may be relatively inexpensive in comparison with the cost of a the mattress. Further, and in those cases where the soiling can be removed by cleaning, it is usually easer and less expensive to clean a topper than to clean the mattress which it protects or to replace the mattress. As a consequence, those in the industry recognize the importance of encouraging the use of toppers in conjunction with the leasing of bedding.

Needless to say, one of the most common forms of mattress/topper soiling is via spilled or excreted liquids. A non-waterproof foam topper (e.g., a foam topper encased in permeable materials) will absorb a limited amount of such liquid but will then pass the remainder on through to the bedding underneath. A waterproof topper will, of course, completely protect the underlying mattress, but can be uncomfortable to lie upon as it does not "breathe."

Heretofore, as is well known in the bedding arts, there has been a need for an invention to address and solve the above-described problems and, more particularly, there has been need for a mattress topper that completely protects the underlying bedding against the introduction of liquids, but which is comfortable to lie upon. Additionally, the topper should be reversible so that in the event that the upper surface of the topper is soiled, it can at least temporarily be inverted and a clean side presented to the user. Accordingly, it should now be recognized, as was recognized by the present inventor, that there exists, and has existed for some time, a very real need for a system for a mattress topper that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

In accordance with a first aspect of the instant invention, there is provided a mattress topper which is designed to be placed atop a conventional mattress and/or box spring combination. In the preferred arrangement the topper consists of a "sandwich" of three layers. The outer layers are preferably comprised of open cell foam of a thickness about equal to one inch or so. The inner layer is an impermeable central liner which is preferably made of a material such as plastic. The function of the central liner is to prevent the migration of fluids from one side of the topper to the other. Thus, although the foam upper layer is very absorbent, an inadvertent spill or other deposit of moisture will be blocked in its migration through the topper by the central waterproof member, thereby protecting both the lower member and the mattress below from exposure to the moisture. Finally, in the preferred arrangement the instant topper will be reversible so that, in the event that the upper surface becomes soiled, the topper can be inverted and thereafter further used.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to apply to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

According to a preferred aspect of the instant invention, there is provided a mattress topper which is designed to be placed or affixed atop a conventional mattress and/or box spring combination and which preferably consists of a "sandwich" of three layers. The two outer layers and are preferably comprised of open cell foam. The central layer is an impermeable central liner which is preferably made of a material such as plastic. The function of this central member is to prevent the migration of fluids through the topper and into the bedding beneath. Thus, although the foam upper layer is very soft, absorbent, and comfortable to lay upon, an inadvertent spill or other deposit of moisture will be blocked in its migration through the topper by its waterproof central core.

Figure 1:
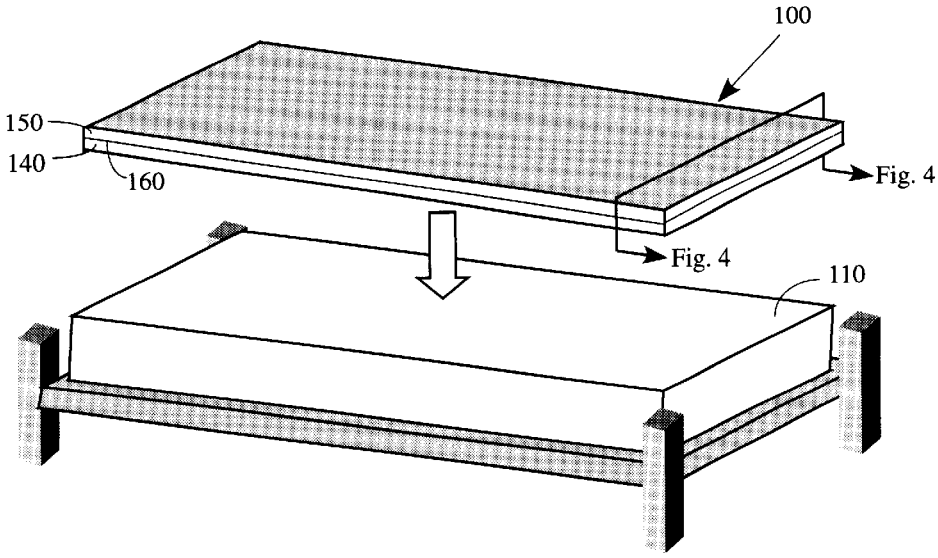
FIG. 1 contains an illustration of the general environment of the instant invention.
Figure 4:
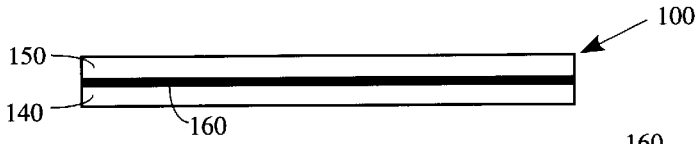
FIG. 4 contains an end-view of a preferred embodiment of the instant invention.

In more particular and turning now to FIGS. 1 and 4, the instant invention 100 is designed to be placed atop a conventional mattress 110 and/or box springs 120 combination. As is apparent in these figures, in a preferred arrangement the topper 100 consists of a three layers: two outer foam layers 140 and 150 and a central waterproof layer 160. Additionally, although not shown in FIG. 1, it is anticipated that the topper 100 as-illustrated would be completely encased by a cotton, wool, or similar fabric external shell. However, that is not essential to the operation of the instant invention.

The outer two layers 140 and 150 are preferably comprised of open cell foam of a thickness about equal to one inch or so. That being said, those of ordinary skill in the art will recognize that the precise thickness of the foam is immaterial to the operation of the instant invention and, indeed, the upper and lower layers do not even need to be the same type of foam or same thickness. In a preferred arrangement, the foam layers 140 and 150 will be an "egg crate" type or similar convoluted foam sheets (not illustrated in the figure). Convoluted foam may be preferable in some instances because it can yield a more comfortable surface upon which to rest. As is conventionally done, if two egg cratetype foam layers are used for upper 150 and lower 140 topper members, the flat surfaces of the each foam pad would preferably be placed facing each other on either side of the water proof member 160. This would yield a topper 100 which, in the event that the upper member 150 became soiled, could be inverted to present the presumably clean lower surface of the lower member 140 to the user.

The inner layer 160 is preferably an impermeable central liner which is made of a sheet of material such as PVC or some other plastic. In the preferred arrangements, the inner layer 160 takes the form of an unbroken sheet of waterproof material that extends throughout the entire contact region between the two outer layers. The function of the central liner 160 is to prevent the migration of fluids from one side of the topper 100 to the other. Thus, even though the foam upper layer 150 might be chosen to be a very absorbent material, an inadvertent spill or other deposit of moisture on its upper surface will be blocked in its migration through the topper 100 by the central waterproof member 160, thereby protecting both the lower member 150 and the mattress below from exposure to the moisture. It should be noted that the central member 160 is preferably adhesively attached to the upper and lower layers, so that it does not bunch or creep during use.

Figure 5:
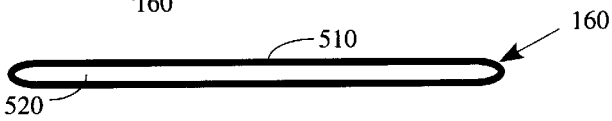
FIG. 5 illustrates a preferred arrangement, wherein the central impermeable layer comprises a foam stiffener core encased by an impermeable layer.

In another preferred arrangement and as is illustrated in FIG. 5, the central member 160 will take the form of a stiffener which is completely encased in plastic or a similar impermeable material. That is, in this embodiment the central member 160 is preferably comprised of an external impermeable wrapping 510 which encases in a planar stiffener 520 core which could be made of many different materials, but which is preferably made of a relatively stiff foam or other resilient material. One function of which is served by the use of the stiffener 520/wrapping 510 combination is that this arrangement is less likely to creep or bunch up when the topper 100 is used. Thus, in this preferred embodiment the central member 160 still functions as an impermeable barrier between the upper 150 and lower 140 members as described previously, but additionally serves to keep the topper 100 in a more comfortable arrangement.

Additionally, and in the another preferred embodiment, the topper 100 will be completely encased in a cloth or other porous covering which would protect its central core from exposure to dirt and other surface contaminants.

The topper 100 members 140, 150, and 160 might be formed into a single unit (e.g., via adhesion) or the members might be left separate and encased in a tightly fitting cover. Either way, it is important that the central member 160 stay at least approximately aligned with the upper 150 and lower 140 members so as to maintain its protective role. Obviously, that requirement might be met in many different ways.

Figure 2:
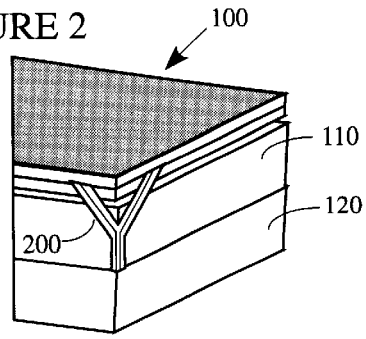
FIG. 2 illustrates a preferred arrangement, wherein the instant invention is affixed to a mattress/box springs combination using a "Y" type fastener.
Figure 3:
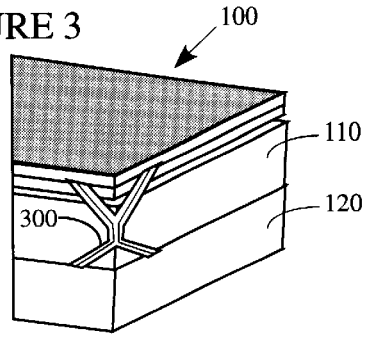
FIG. 3 illustrates a preferred arrangement, wherein the instant invention is affixed to a mattress/box springs combination using a "X" type fastener.

According to another preferred feature of the instant invention and is generally illustrated in FIGS. 2 and 3, the instant inventor has devised two preferred alternative ways of attaching his topper 100 to the mattress. In a first embodiment (FIG. 2), a Y-shaped attachment 200 is affixed at each corner of the topper 100 and to the underside of the mattress 110 or top of the box spring 120. The advantage of the Y-shaped attachment 200 is that the branching arms of the Y can at least partially embrace the corner of the mattress 110, thereby tending to hold the topper 100 in place more securely than it would be held otherwise. Although the arms of the attachment 200 and its base might be affixed in many different ways, in one preferred snaps are used to affix the attachment 200 to the topper 100 on one end, and the mattress 110 on the other, so that the attachment may be completely removed when the topper is changed. Obviously, many different arrangements are possible and have been specifically contemplated by the instant inventor (e.g., using Velcro, buttons, etc.). Additionally, it should be clear that is not a requirement that the attachment 200 be capable of complete separation from the topper 100. Finally, note that the attachment 200 might be made of any number of materials including nylon webbing, elastic, fabric of any kind, etc. In brief, it could be made of any material having sufficient tensile strength to attach a topper to a bed.

Additionally, the instant inventor also suggests another attaching arrangement substantially similar to that described above, but wherein the attaching strap takes the shape of an "X" 300. As illustrated in FIG. 3, the X-shaped attachment 300 is designed to embrace at least a portion of the corner of the mattress 350 and further prevent the topper 100 from moving.

Of course those of ordinary skill in the art will recognize that there many other means of attaching the instant invention to the underlying bed. For example, Velcro (preferably at least at the corners), snaps, buttons, double sided tape, straps of any sort or configuration, one or more zippers, a cloth skirt with elastic at the lower periphery configured to enclose part of the mattress (like a fitted sheet), etc. Of course, in the preferred embodiment the means of attaching the instant invention to the mattress will be something that allows the topper 100 to be inverted so that the clean underside can be used further if the upper surface becomes soiled.

Finally, it should be noted that the instant invention is especially suitable for use with rental bedding, the reuse of which is subject to state and/or federal regulation. A principal advantage of the instant topper 100 is that it potentially permits the underlying mattress 110 to be reused without the need for extensive fumigation, depending on the laws of the particular state in which the topper is sold or leased.

CONCLUSIONS

In summary, one advantage of the instant arrangement over the prior art is that it presents a comfortable sleeping surface to the user while simultaneously protecting the mattress that lies underneath. By the use of a foam upper surface 150, the sleeper is prevented from having direct contact with the water proof liner 160, thereby making for a more pleasant the resting experience.

Egg crate foam (convoluted) foam is a preferred choice for use in members 140 and 150, but many other types of bedding material might be used including any visco-elastic foam pad, memory foam, standard rectangular foam pads, latex pads, polystyrene pads, Neoprene pads, polyethylene pad, and non-foam products such as polyfill, cotton and/or wool pads, etc. Obviously, antibacterial agents could added to the members 140 and 150 according to the desires of the manufacturer. The key requirement is that the upper and lower members of the topper 100 must be porous so as to present the user with a comfortable resting surface. Thus, in the claims that follows the term "pad" should be interpreted to cover any porous, padded material suitable for use as bedding materials, including conventional foam.

Although the previous discussion has focused with the use of the instant topper on a conventional bed, it should be noted and remembered that the instant invention is suitable for use with any sort of sleeping surface including a water bed, an air mattress, a cot, or, if appropriate the floor. Thus, in the claims that follow the term "bed" should be used in its broadest sense to include any surface upon which a person would want to rest or sleep. Additionally, the term "mattress" should also be used to encompass those cases where the topper is laid directly on top of the box springs or on some other support surface. Thus, the term "support surface" will be used hereinafter in its broadest possible sense to refer to a mattresses, box springs, a pad, or any other bedding.

Thus, it is apparent that there has been provided, in accordance with the invention, a mattress topper that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A topper for use on a bed, adapted to be removably positioned on a mattress portion of the bed, comprising:

(a) a generally rectangular upper pad, comprised of a porous, open celled foam, having an upper surface and a lower surface, said upper pad being sized to at least approximately cover said sleeping area of the bed;

(b) a generally rectangular lower pad comprised of a porous open celled foam, said lower pad having an upper surface and a lower surface, said lower pad being sized to at least approximately cover said sleeping area of the bed, said lower surface of said lower pad being porous to the passage of liquids; and, (c) a central impermeable member positioned between said upper pad and said lower pad, said central member being impermeable to the passage of liquids therethough, said central member being sized commensurate with said upper pad and said lower pad, and said lower surface of said upper pad and said upper surface of said lower pad being in contact therewith said central impermeable member comprising a resilient foam planar core completely encased within an impermeable cover.

2. The topper according to claim 1, further comprising:

(d) a permeable outer covering, said outer covering completely enclosing said upper pad, said lower pad, and said central impermeable member.

3. The topper according to claim 2, wherein said outer covering is comprised of cotton.

4. The topper according to claim 1, wherein said upper member is comprised of visco-elastic foam.

5. The topper according to claim 1, wherein said upper member and said lower member are comprised of egg crate foam.

6. The topper according to claim 1, wherein said topper has four corners, and further comprising:

(d) at least one attachment for attaching said topper to the bed, each of said at least one attachments being affixed to a corner of the topper and a corner of the bed.

7. The topper according to claim 6, wherein each of said at least one attachments is removably attached to said topper.

8. The topper according to claim 6, wherein each of said at least one attachments is formed in the shape of a "Y" and is positionable to embrace at least one corner of the bed.

9. The topper according to claim 6, wherein each of said at least one attachments is formed in the shape of a "X" and is positionable to embrace at least one corner of the bed.

10. The topper according to claim 1, wherein said cover is comprised of plastic.

11. An apparatus for rest and sleep, comprising:

(a) a bed, said bed having a generally rectangular support surface positionable thereon, said support surface for supporting a user in a resting position;

(b) a generally rectangular upper pad, said upper pad comprised of a porous open celled foam having an upper surface and a lower surface, said upper pad being sized to at least approximately cover said support surface of said bed;

(b) a generally rectangular lower pad, said lower pad comprised of a porous open celled foam having an upper surface and a lower surface, said lower pad being sized commensurate to said upper pad, said lower surface of said lower pad being porous to the passage of liquids; and, (c) a central impermeable member positioned between said upper pad and said lower pad, said central member having an upper surface and a lower surface, said central member being impermeable to the passage of liquids therethough, and said central member being sized commensurate with said upper pad and said lower pad, wherein said lower surface of said upper pad is in contact with said upper surface of said central member, and said upper surface of said lower pad is in contact with said lower surface of said central member said central impermeable member comprising a resilient foam planar core completely encased within an impermeable cover.

12. The topper according to claim 11, wherein said topper has four corners, and further comprising:

(d) at least one attachment for attaching said topper to the bed, each of said at least one attachments being affixed to a corner of the topper and a corner of the support surface.

13. The topper according to claim 12, wherein each of said at least one attachments is removably attached to said topper.

14. The topper according to claim 12, wherein each of said at least one attachments is formed in the shape of a "Y" and is positionable to embrace one corner of the support surface.

15. The topper according to claim 12, wherein each of said at least one attachments is formed in the shape of a "X" and is positionable to embrace one corner of the support surface.

* * * * *